US005495635A

United States Patent [19]

Williams

[11] Patent Number: 5,495,635

[45] Date of Patent: Mar. 5, 1996

[54] PAINT TRIMMING DEVICE

[76] Inventor: Thomas A. Williams, 628 D St. SE., Miami, Okla. 74354

[21] Appl. No.: 459,355

[22] Filed: Jun. 2, 1995

[51] Int. Cl.[6] ..... B05C 17/00

[52] U.S. Cl. ..... 15/210.1; 15/145

[58] Field of Search ..... 15/145, 210.1

[56] References Cited

U.S. PATENT DOCUMENTS

| | | | |
|---|---|---|---|
| 2,810,148 | 10/1957 | Wood, Jr. | 15/210.1 |
| 2,853,731 | 9/1958 | Lancaster | 15/210.1 |
| 2,985,902 | 5/1961 | Sopocy | 15/210.1 |
| 3,359,589 | 12/1967 | Moore | 15/210.1 |
| 3,599,265 | 8/1971 | D'Ercoli | 15/210.1 |
| 3,605,165 | 9/1971 | Burns | 15/210.1 |
| 3,708,821 | 1/1973 | Chase et al. | 15/210.1 |
| 3,736,616 | 6/1973 | Seip | 15/210.1 |
| 4,127,911 | 12/1978 | Cupp et al. | 15/210.1 |
| 4,215,448 | 8/1980 | Burns et al. | 15/210.1 |
| 4,300,258 | 11/1981 | Burns et al. | 15/210.1 |
| 4,424,603 | 1/1984 | Balint et al. | 15/210.1 |
| 4,819,294 | 4/1989 | Calvert | 15/209.1 |
| 4,829,623 | 5/1989 | Brezette et al. | 15/210.1 |
| 5,117,527 | 6/1992 | Milkie | 15/210.1 |
| 5,134,745 | 8/1992 | Burns et al. | 15/210.1 |
| 5,209,781 | 5/1993 | Milkie | 118/264 |

FOREIGN PATENT DOCUMENTS

| | | | |
|---|---|---|---|
| 1181230 | 2/1970 | United Kingdom | 15/210.1 |

*Primary Examiner*—Mark Spisich
*Attorney, Agent, or Firm*—William R. Sharp

[57] ABSTRACT

A paint trimming device is provided for applying paint to a first surface closely adjacent to an adjoining surface. The device comprises a base having opposing faces and a body portion extending between the faces, a a handle projecting outwardly from one face and having extension capability (such as being connectable to an extension pole), a paint pad having a peripheral edge and being secured to the base upon the other face, and a spacer which extends outwardly from the body portion and has its outermost points defining a closed linear boundary whose perpendicular projection, in a plane in which the paint pad lies, completely surrounds and is spaced from the peripheral edge of the paint pad.

11 Claims, 2 Drawing Sheets

PAINT TRIMMING DEVICE

BACKGROUND OF THE INVENTION

The invention relates to paint trimming devices, and more particularly to paint trimming devices adapted to apply paint to a first surface closely adjacent to an adjoining second surface.

Such paint trimming devices typically comprise a base, a handle projecting from one face of the base, a paint pad secured to the base upon an opposing face, and spacers (such as wheels) associated with the base for spacing the edge of the paint pad from a surface adjoining the surface to which paint is applied. The handle is designed to be gripped by the user closely adjacent to the base, thus requiring the use of a step ladder to trim high portions of a surface, such as a wall, or uncomfortable stooping and/or kneeling to trim low portions of the surface. Such trimming is inconvenient and potentially hazardous for an ambulatory individual, and is impossible for a handicapped individual confined to a wheelchair.

SUMMARY OF THE INVENTION

It is, therefore, an object of the invention to provide a paint trimming device of the type described above, which enables the ambulatory user to conveniently and safely apply paint to a surface (i.e. a wall) at any location adjacent to adjoining surfaces (i.e. a ceiling, moldings around a doorway or window, molding along a floor, or another wall) without requiring a step ladder or any stooping or kneeling.

It is also an object of the invention that the paint trimming device be useable by a handicapped individual to apply paint to a surface, as described above, from a sitting position in a wheelchair.

The above objects are realized by a paint trimming device for applying paint to a first surface closely adjacent to an adjoining second surface, comprising: a base having opposing first and second faces and a body portion extending between the faces; a handle means projecting outwardly from the first face such that it can be gripped by a user closely adjacent to the base, and also having extension capability allowing the user to manipulate the base from a position remote from the base; a paint pad means, for carrying paint to be applied to the first surface, which has a peripheral edge and is secured to the base upon the second face thereof; and a spacer means, extending outwardly from the body portion of the base, for spacing the peripheral edge of the paint pad means from and out of contact with the second surface while applying paint to the first surface, the outermost points of the spacer means defining a closed linear boundary whose perpendicular projection, in a plane in which the paint pad means lies, completely surrounds and is spaced from the peripheral edge of the paint pad means.

According to a preferred embodiment of the invention, peripheral edges of the second face and paint pad means have four substantially straight sides to define respective quadrilaterals (i.e. rectangles), and the closed linear boundary also defines a quadrilateral. Such preferred embodiment also employs four wheels rotatably mounted to the body portion of the base at respective positions adjacent to the corners of the quadrilateral defined by the sides of the second face peripheral edge. Any one of the four sides of the paint pad means peripheral edge can accordingly be spaced from and out of contact with a surface adjoining the surface to which paint is applied. This capability, in combination with the extension capability of the handle means (preferably a threaded cavity for receiving an extension pole), enables an ambulatory individual to trim a surface along virtually any adjoining surface (regardless of orientation or vertical distance from the floor) without the need for a step ladder or any kneeling or stooping, and further enables the handicapped individual to accomplish such trimming from a wheelchair. These advantages of the invention will become more clearly apparent in the discussion of its operation and use in the following Detailed Description of the Invention.

DETAILED DESCRIPTION OF THE INVENTION

A preferred embodiment of the invention is described below with reference to the drawings. First, however, several terms as used in such description and in the appended claims will be defined.

The term "perpendicular projection" with respect to a plane means a projection in a direction perpendicular to the plane.

The term "linear boundary" is broadly construed to be any boundary that includes, and is therefore defined by, a plurality of points, and is capable of being generated by a moving point.

The term "quadrilateral" means a polygon having four sides.

Figure 1:
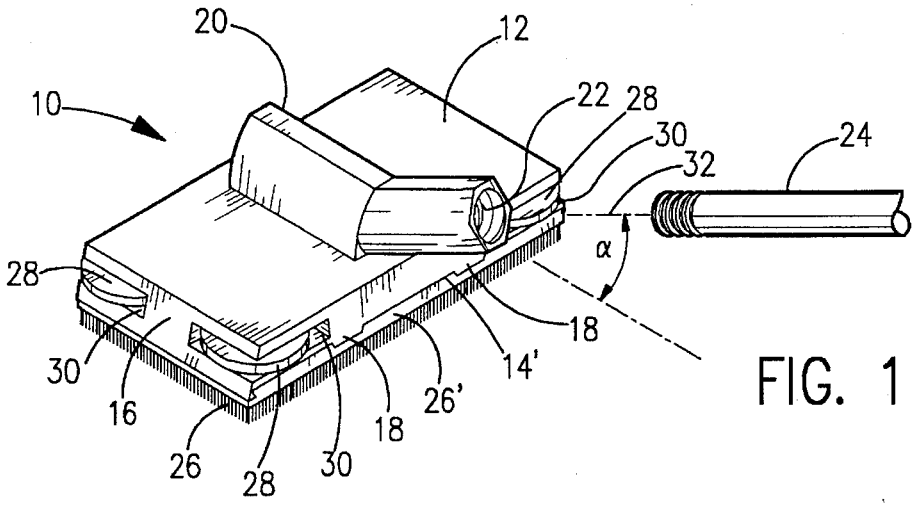
FIG. 1 is a perspective view of a preferred embodiment of a paint trimming device in accordance with the invention. The illustrated paint trimming device includes a base, wheels rotatably mounted to the base, a handle with extension capability, and a paint pad secured to the base.

Referring now to FIG. 1, the illustrated paint trimming device comprises: a base 10 preferably composed of a moldable, relatively rigid plastic such as polyethylene or polypropylene, and having a face 12, an opposing face 14 (of which only the peripheral edge 14' is visible in FIG. 1), a body portion 16 extending between faces 12 and 14, and abutment tabs 18 projecting from peripheral edge 14, a handle 20 projecting outwardly from face 12, and preferably integral with base 10, such that it can be gripped by a user closely adjacent to base 10, but also having extension capability by means of a substantially cylindrical, threaded cavity 22 for receiving a threaded end of an extension pole 24 to thereby allow manipulation of base 10 from a position remote from the base; a paint pad 26 secured to base 10 upon face 14 so that a peripheral edge 26' of the pad is preferably substantially flush with peripheral edge 14'; and four wheels 28 (of which only three are visible in FIG. 1) which are rotatably mounted to body portion 16 within corresponding slots 30 so that portions of each wheel extend outwardly from the body portion. Wheels 28 can be composed of a plastic similar to that of base 10, and function to space peripheral edge 26' from and out of contact with a surface adjoining the surface to which paint is applied.

As further shown in FIG. 1, threaded cavity 22 has a longitudinal axis 32, which defines an acute angle α with respect to substantially parallel planes in which face 14 and paint pad 26 lie. Angle α is preferably in the range of about 20 to about 40 degrees, and is most preferably about 30 degrees. The threaded end of extension pole 24 can be substantially coaxially received within threaded cavity 22 to thereby lie along longitudinal axis 32. Extension pole 24 can be composed of any suitable material, such as wood or plastic, and can be of any suitably convenient length to accomplish trimming in a room with a particular ceiling height. Although threads are employed to connect extension pole 24 to handle 20 in the illustrated embodiment, other connecting means are within the scope of the invention, such as a snap-lock, quick release type connecting mechanism.

Figure 2:
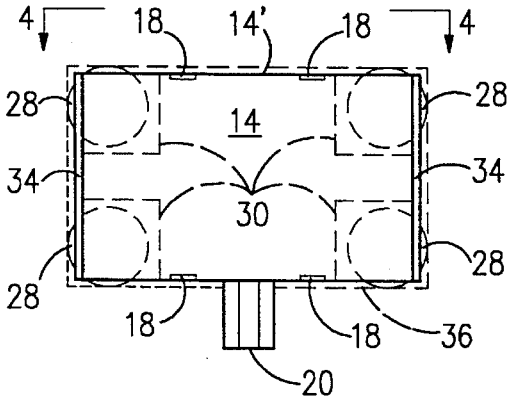
FIG. 2 is a rear plan view of the paint trimming device of FIG. 1 without the paint pad secured to the base.

Referring now to FIG. 2, this view of the paint trimming device (without the paint pad secured thereto) shows face 14. Peripheral edge 14' of face 14 has four substantially straight sides that define a quadrilateral, which in the illustrated embodiment is a rectangle. Along one side of peripheral edge 14' are a first pair of abutment tabs 18, which are also shown in FIG. 1, and along an opposing side are a second pair of abutment tabs 18. A pair of channel-forming flanges 34 extend along the other two opposing sides of peripheral edge 14'. Tabs 18 and flanges 34 cooperate to secure the paint pad to the base upon face 14, as will be discussed further below.

Each of wheels 28 and corresponding slots 30 are shown in broken lines in FIG. 2. Each wheel 28 is mounted adjacent to a corresponding corner of the quadrilateral defined by the four sides of peripheral edge 14'. Referring now to FIG. 2 in conjunction with FIG. 1, and with respect to each wheel 28, a first portion extends outwardly from the body portion 16 of base 10 at a position adjacent to one corner-defining side, and a second portion extends outwardly from body portion 16 at a position adjacent to the other corner-defining side. Accordingly, the outermost points of wheels 28 define a closed linear boundary 36 whose perpendicular projection, in a plane in which paint pad 26 lies, completely surrounds and is spaced from (preferably about 1/16 inch) peripheral edge 26'. Moreover, linear boundary 36 also defines a quadrilateral, in this case a rectangle, having sides that are substantially parallel to corresponding sides of peripheral edge 14' and peripheral edge 26'.

Figure 3:
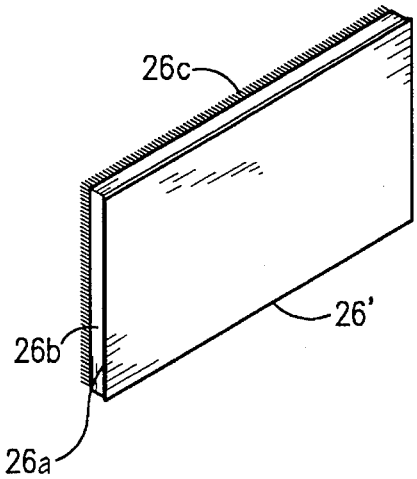
FIG. 3 is a perspective view of the paint pad shown in FIG. 1.

Referring now to FIG. 3, paint pad 26 is shown as preferably comprising a flexible plastic backing **26*a*, an open celled foam layer 26*b* preferably composed of a polyester such as polyurethane, and bristles 26*c* of nylon or mohair suitably secured to and projecting from the exposed face of foam layer 26*b*. Peripheral edge 26'** can be seen to have four substantially straight sides defining a quadrilateral, in this case a rectangle.

Referring now to FIG. 3 in conjunction with FIGS. 1 and 2, paint pad 26 is secured to the base upon face 14 by positioning the paint pad to have backing **26*a* facing face 14, and bending the pad slightly in order to position the short sides of peripheral edge 26' adjacent to channel-forming flanges 34; with portions of backing 26*a* immediately adjacent to such short sides fitted snugly within corresponding channels, and with the long sides of peripheral edge 26' abutting respective pairs of abutment tabs 18. As secured to base 10, backing 26*a* of paint pad 26 is closely adjacent to or contacting face 14, and the sides of peripheral edge 26' are substantially parallel to and substantially flush with the sides of peripheral edge 14'. As will be more apparent in the discussion of FIGS. 6–8, any one of the four sides of peripheral edge 26' can be spaced from and out of contact with a surface by a pair of wheels 28**, while applying paint closely adjacent to such surface upon an adjoining surface.

Figure 4:
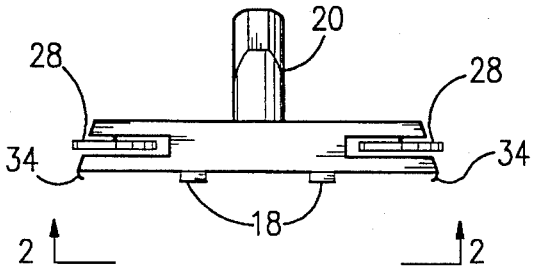
FIG. 4 is an end view of the paint trimming device of FIG. 1 without the paint pad secured to the base.

Referring now to FIG. 4, this end view of the paint trimming device without paint pad 26 more clearly shows the shape of flanges 34, and the channels formed by such flanges.

Figure 5:
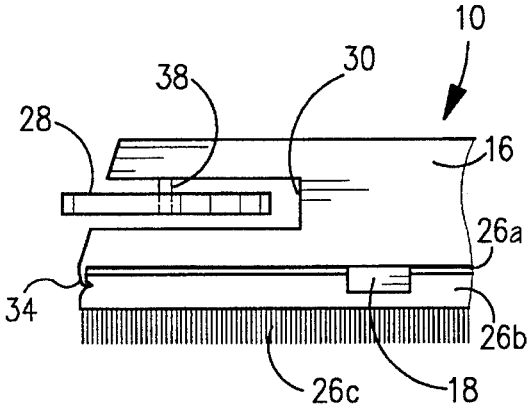
FIG. 5 is a close-up view of one portion of the paint trimming device of FIG. 1.

Referring now to FIG. 5, this close-up view more clearly shows the manner in which each wheel 28 is rotatably mounted to body portion 16 within slot 30. Post 38 projects from an internal, slot-defining surface of body portion 16, and is preferably integral with body portion 16. An end portion of post 38 is received in a central aperture of wheel 28 so as to permit rotation of wheel 28 with respect to post 38. Although not shown, wheel 28 can be retained upon post 38 by means of an annular flange extending around the central aperture which snaps into an annular recess extending around post 38. Of course, it is within the scope of the invention to rotatably mount wheels 28 to body portion 16 in any other suitable manner.

FIG. 5 also more clearly shows the manner in which paint pad 26 is secured to base 10. Flange 34 is shown as indenting foam layer **26*b*, with backing layer 26*a*** positioned within the channel formed by the flange.

Use of the above-described paint trimming device and its associated advantages will now be described with reference to FIGS. 6–8.

Figure 6:
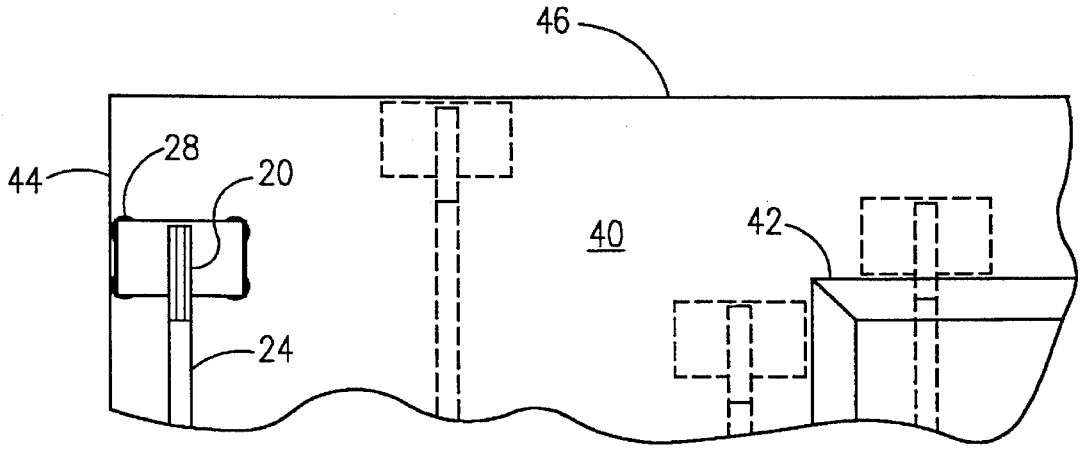
FIGS. 6–8 show the manner in which the illustrated paint trimming device may be used in applying paint to different locations on a wall closely adjacent to various adjoining surfaces.

Referring to FIG. 6, the upper portion of a wall 40 and the upper portion of a doorway molding 42 are shown. A paint trimming device of the invention, as shown in solid lines, has an extension pole 24 connected to its handle 20, and is positioned in a manner to trim along and closely adjacent to an adjoining wall 44. In such position, wheels 28 on the left side of the illustrated paint trimming device are in contact with wall 44 so as to space the left side of the paint pad peripheral edge (not visible in FIG. 6) away from and out of contact with wall 44. Shown in broken lines is the paint trimming device in different positions for trimming along other surfaces adjoining wall 40, including ceiling 46, a vertical section of doorway molding 42, and an upper and horizontal section of doorway molding 42. Note that in moving the paint trimming device to any of the above-described positions, the orientation of the paint trimming device does not need to be changed, and the extension pole can remain in the vertical position for ease of manipulation by a user standing on the floor or sitting in a wheelchair.

Figure 7:
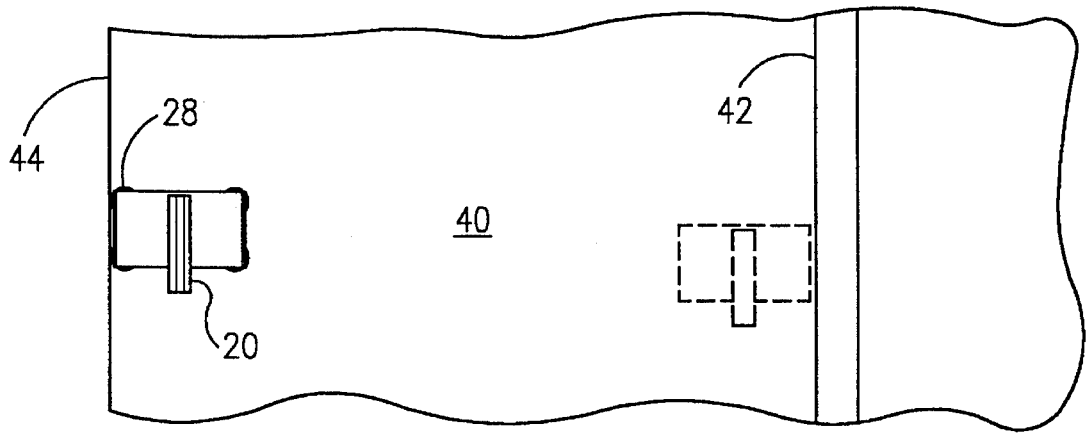

Referring now to FIG. 7, a middle portion of wall 40 and doorway molding 42 are shown. The paint trimming device, as shown in solid lines, is positioned to trim along wall 44 with the extension pole removed. A user can easily manipulate the paint trimming device at this elevation by gripping handle 20. If desired, of course, the extension pole could remain connected to handle 20. The paint trimming device is shown in broken lines as being moved to a position for trimming along a vertical section of doorway molding 42, without any change in the orientation of the device.

Figure 8:
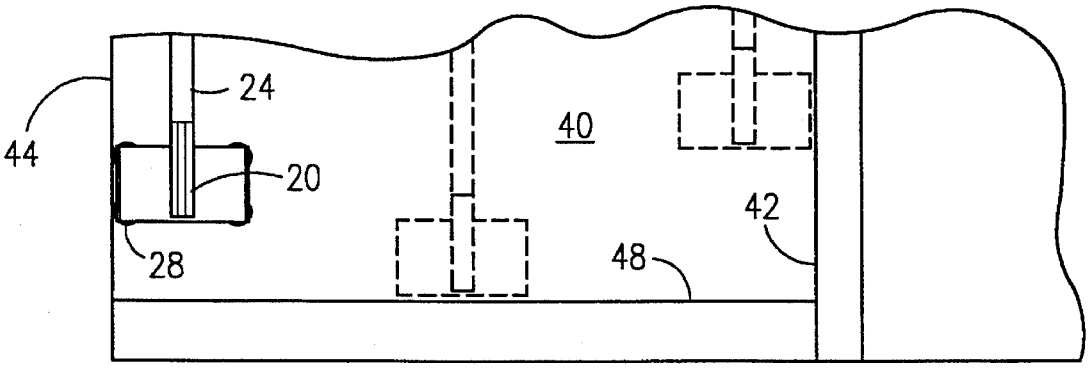

Referring now to FIG. 8, a lower portion of wall 40 and doorway molding 42, as well as floor molding 48, are shown. The paint trimming device, as shown in solid lines, has been reversed in orientation as compared to the orientation of FIGS. 6 and 7, and extension pole 24 is connected to handle 20 for trimming along a lower portion of wall 44. The paint trimming device is shown in broken lines in positions for trimming along floor molding 48 and along a vertical section of doorway molding 42.

It should be apparent from the above discussion and FIGS. 6–8 that the paint trimming device of the invention can be used by an ambulatory individual to trim different locations of wall 40, along various adjoining surfaces at any height, without the need for a step ladder or any stooping or kneeling. The paint trimming device of the invention also enables a handicapped individual to accomplish such trimming from a sitting position in a wheelchair. Therefore, safety and utility are maximized by the invention.

Obviously, many modifications and variations of the present invention are possible in light of the above teachings. For example, outwardly extending but fixed spacing guides could replace some or all of the wheels, or positioning of such wheels or spacing guides could be different than that shown and previously described in accordance with broad aspects of the invention, as long as the outermost points define a linear boundary as specified above. It is, therefore, to be understood that within the scope of the appended claims, the invention may be practiced otherwise than as specifically described.

That which is claimed is:

1. A paint trimming device for applying paint to a first surface closely adjacent to an adjoining second surface, comprising:

a base having opposing first and second faces and a body portion extending between the faces;

a handle means projecting outwardly from the first face such that it can be gripped by a user closely adjacent to the base, and also having extension capability allowing the user to manipulate the base from a position remote from the base;

a paint pad means, for carrying paint to be applied to the first surface, which has a peripheral edge and is secured to the base upon the second face thereof; and spacer means, extending outwardly from the body portion of the base, for spacing the peripheral edge of the paint pad means from and out of contact with the second surface while applying paint to the first surface, the outermost points of the spacer means defining a closed linear boundary whose perpendicular projection, in a plane in which the paint pad means lies, completely surrounds and is spaced from the peripheral edge of the paint pad means.

2. A paint trimming device as recited in claim 1, wherein the second face of the base has a peripheral edge with four substantially straight sides defining a first quadrilateral, the peripheral edge of the paint pad means also has four substantially straight sides which define a second quadrilateral and which are substantially parallel to corresponding sides of the second face peripheral edge, and the closed linear boundary defines a third quadrilateral having sides substantially parallel to corresponding sides of the second face peripheral edge and paint pad means peripheral edge, whereby the spacer means allows any one of four sides of the paint pad means peripheral edge to be spaced from and out of contact with the second surface while applying paint to the first surface.

3. A paint trimming device as recited in claim 2, wherein the spacer means comprises a plurality of wheels rotatably mounted to the body portion of the base, each wheel having at least a portion thereof extending outwardly from the body portion of the base.

4. A paint trimming device as recited in claim 3, wherein the first quadrilateral has four corners of which each corner is defined by a pair of corner-defining sides, and wherein the spacer means comprises four wheels, each wheel being rotatably mounted adjacent to a corresponding corner of the first quadrilateral so that each such wheel has a first portion, extending outwardly from the body portion of the base at a position adjacent to one corner-defining side of the second face peripheral edge, and a second portion extending outwardly from the body portion of the base at a position adjacent to the other corner-defining side of the second face peripheral edge.

5. A paint trimming device as recited in claim 4, wherein each of the first, second, and third quadrilaterals is a rectangle.

6. A paint trimming device as recited in claim 5, wherein the second face and paint pad means lie in respective planes that are substantially parallel to one another.

7. A paint trimming device as recited in claim 6, wherein the handle means has associated therewith a connecting means for fixedly connecting one end of an extension pole to the handle means.

8. A paint trimming device as recited in claim 7, wherein the connecting means is a substantially cylindrical, threaded cavity in the handle means.

9. A paint trimming device as recited in claim 8, wherein the cavity has a longitudinal axis which defines an acute angle of about 20 to about 40 degrees with respect to parallel planes in which the second face and paint pad means lie.

10. A paint trimming device as recited in claim 9, further comprising the extension pole connected to the handle means by means of a threaded end substantially coaxially received within the threaded cavity.

11. A paint trimming device as recited in claim 10, wherein the sides of the paint pad means peripheral edge are substantially flush with corresponding sides of the second face peripheral edge.

* * * * *

US005495635C1

(12) EX PARTE REEXAMINATION CERTIFICATE (7197th)

United States Patent
Williams

(10) Number: US 5,495,635 C1
(45) Certificate Issued: Dec. 1, 2009

(54) PAINT TRIMMING DEVICE

(75) Inventor: Thomas A. Williams, Miami, OK (US)

(73) Assignee: Leslie L. Jacobs, Jr., Bethesda, MD (US)

Reexamination Request:
No. 90/008,595, May 21, 2007

Reexamination Certificate for:

| | |
|---|---|
| Patent No.: | **5,495,635** |
| Issued: | **Mar. 5, 1996** |
| Appl. No.: | **08/459,355** |
| Filed: | **Jun. 2, 1995** |

(51) Int. Cl.
*B05C 17/00* (2006.01)
*B05C 17/02* (2006.01)

(52) U.S. Cl. ..... 15/210.1; 15/145
(58) Field of Classification Search ..... None
See application file for complete search history.

(56) References Cited

U.S. PATENT DOCUMENTS

| | | | |
|---|---|---|---|
| 817,117 | A | 4/1906 | Isaacs |
| 1,691,024 | A | 11/1928 | Gedge |
| 2,156,270 | A | 5/1939 | Smith |
| 2,438,338 | A | 3/1948 | Horn |
| 2,810,148 | A | 10/1957 | Wood |
| 2,853,731 | A | 9/1958 | Lancaster |
| 2,985,902 | A | 5/1961 | Sopocy |
| 3,359,589 | A | 12/1967 | Moore |
| 3,388,415 | A | 6/1968 | Werner et al. |
| 3,473,183 | A | 10/1969 | Burns et al. |
| 3,599,265 | A | 8/1971 | D'Ercoli et al. |
| 3,605,166 | A | 9/1971 | Burns et al. |
| 3,704,480 | A | 12/1972 | Whitaker |
| 3,708,821 | A | 1/1973 | Chase et al. |
| 3,717,895 | A | 2/1973 | Chase et al. |
| 3,736,616 | A | 6/1973 | Seip |
| 3,827,100 | A | 8/1974 | Griffin et al. |
| D249,821 | S | 10/1978 | Cooke et al. |
| 4,127,911 | A | 12/1978 | Cupp et al. |
| 4,155,140 | A | 5/1979 | Janssen et al. |
| D256,190 | S | 8/1980 | Janssen |
| 4,215,448 | A | 8/1980 | Burns et al. |
| 4,219,899 | A | 9/1980 | Zurawin et al. |
| 4,300,258 | A | 11/1981 | Burns et al. |
| 4,424,603 | A | 1/1984 | Balint et al. |
| 4,611,941 | A | 9/1986 | Karliner et al. |
| 4,658,461 | A | 4/1987 | Roe et al. |
| 4,819,294 | A | 4/1989 | Calvert |
| 4,829,623 | A | 5/1989 | Brezette et al. |
| 4,991,792 | A | 2/1991 | Pedroia |
| 5,117,527 | A | 6/1992 | Milkie |
| 5,134,745 | A | 8/1992 | Burns et al. |
| 5,209,781 | A | 5/1993 | Milkie |
| 5,331,710 | A | 7/1994 | Tollasepp |
| 5,495,635 | A | 3/1996 | Williams |
| D395,169 | S | 6/1998 | Yang |

*Primary Examiner*—Krisanne Jastrzab

(57) ABSTRACT

A paint trimming device is provided for applying paint to a first surface closely adjacent to an adjoining surface. The device comprises a base having opposing faces and a body portion extending between the faces, a a handle projecting outwardly from one face and having extension capability (such as being connectable to an extension pole), a paint pad having a peripheral edge and being secured to the base upon the other face, and a spacer which extends outwardly from the body portion and has its outermost points defining a closed linear boundary whose perpendicular projection, in a plane in which the paint pad lies, completely surrounds and is spaced from the peripheral edge of the paint pad.

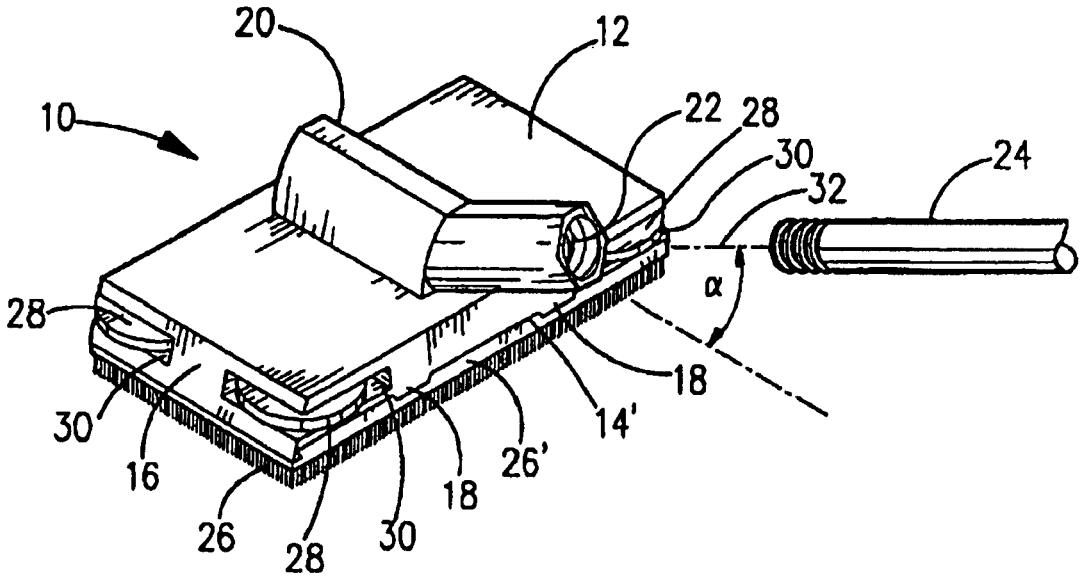

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–11 are cancelled.

* * * * *